US008714424B2

(12) United States Patent
Oddou et al.

(10) Patent No.: US 8,714,424 B2
(45) Date of Patent: May 6, 2014

(54) CARRYING DEVICE WAIST BELT SYSTEM

(75) Inventors: Paul Oddou, Salt Lake City, UT (US); Paul Terry, Park City, UT (US); Thomas Zebucon Franke, Salt Lake City, UT (US); Nathan Miles Kuder, Sandy, UT (US); Kathleen Marie Miller, Salt Lake City, UT (US)

(73) Assignee: Black Diamond Equipment Ltd., Salt Lake City, UT (US)

( * ) Notice: Subject to any disclaimer, the term of this patent is extended or adjusted under 35 U.S.C. 154(b) by 896 days.

(21) Appl. No.: 12/712,326

(22) Filed: Feb. 25, 2010

(65) Prior Publication Data

US 2010/0243694 A1 Sep. 30, 2010

Related U.S. Application Data

(60) Provisional application No. 61/162,730, filed on Mar. 24, 2009.

(51) Int. Cl.
*A45F 3/08* (2006.01)
*A45F 5/02* (2006.01)

(52) U.S. Cl.
USPC ..... 224/262; 224/637

(58) Field of Classification Search
USPC ..... 224/262, 637
See application file for complete search history.

(56) References Cited

U.S. PATENT DOCUMENTS

| | | | | |
|---|---|---|---|---|
| 4,303,186 | A * | 12/1981 | Ollinger, IV | 224/634 |
| 4,676,418 | A * | 6/1987 | Lowe | 224/638 |
| 5,954,250 | A * | 9/1999 | Hall et al. | 224/262 |
| 6,290,111 | B1 * | 9/2001 | Hedenberg et al. | 224/262 |
| 6,637,631 | B2 * | 10/2003 | Lafoux et al. | 224/197 |
| 6,848,120 | B2 * | 2/2005 | Kling et al. | 2/312 |
| 2008/0035686 | A1 * | 2/2008 | Gregory | 224/262 |
| 2008/0203128 | A1 * | 8/2008 | Bass et al. | 224/628 |
| 2011/0108595 | A1 * | 5/2011 | Hoag | 224/633 |

FOREIGN PATENT DOCUMENTS

WO WO2008/089128 * 7/2008 ..... G03G 21/16

* cited by examiner

*Primary Examiner* — Brian D Nash
*Assistant Examiner* — Derek Battisti
(74) *Attorney, Agent, or Firm* — Trent Baker; Baker & Associates PLLC

(57) ABSTRACT

One embodiment of the present invention relates to a user based carrying system capable of independent transportation of a load including a hip-based user attachment system. The carrying system includes an enclosure member having an internal region encased by an internal surface. A user attachment system releasably secures the carrying system to the user for independent transportation without requiring muscular engagement. The user attachment system includes a hip attachment system with a dorsal articulation member and a strap member. The dorsal articulation member includes a front and rear member three-dimensionally moveably coupled to one another. The rear member is coupled to the enclosure member and the front member is coupled to the strap member. The three-dimensional moveable coupling between the front and rear members includes three restricted degrees of freedom configured to efficiently absorb corresponding user hip movements and directly support other user hip movements.

17 Claims, 8 Drawing Sheets

CARRYING DEVICE WAIST BELT SYSTEM

RELATED APPLICATIONS

This application claims priority to U.S. provisional application Ser. No. 61/162,730 filed Mar. 24, 2009, the contents of which are incorporated by reference.

FIELD OF THE INVENTION

The invention generally relates to backpacks and other carrying systems which encircle a user's waist for support. In particular, the present invention relates to a waist belt coupling system for improving the performance of a carrying system.

BACKGROUND OF THE INVENTION

Bags and carrying cases are commonly used to transport items from one location to another. Items may be contained and supported within an internal enclosure during transportation. Most bags also include some form of user attachment system that allows a user to support the bag during transportation. Many types of user attachment systems are designed to be positioned on a user's body in a configuration that supports the bag but does not require the use of appendages. For example, backpack shoulder straps may be individually looped around each of a user's shoulders to support the backpack in an orientation that does not require the user to hold it with their arms. However, each type of user-attachment system possesses particular performance characteristics and limitations that affect the utility of the bag. For example, a single shoulder strap or messenger-style user attachment system is undesirable for exclusive support of a bag with heavier loads due to potential back and/or shoulder discomfort.

Bags and carrying cases may be further classified according to their overall shape, user-attachment system(s), and material of composition. One subset of carrying cases includes bags which attach to a user's waist, including backpacks, hip-packs, shoulder bags, messenger bags, etc. These types of carrying systems may also include other user-attachment systems in addition to a waist attachment such as shoulder straps, handles, etc. A waist attachment system refers to some form of straps, belts, hooks, etc. that couple to the waist region of a user. In general, the carrying portion of the carrying system is primarily positioned on the dorsal side of the user, and the waist attachment system includes two straps which extend from the left and right sides respectively to the ventral side of the user's body. The two straps may then be releasably coupled together so as to form a singular support strap encircling the user's dorsal and ventral waist region from the carrying portion of the carrying system. By encircling the user's waist with support straps, weight is distributed between the carrying portion of the carrying system and the user's waist".

One of the problems with existing waist-type user attachment systems is the inability of the waist attachment system to efficiently articulate in accordance with the movement of the user. When a user walks or runs, each hip sequentially rises and falls within the coronal plane a small amount corresponding to the leading leg/foot in order to allow the hip joint to properly articulate. Conventional hip attachment systems are rigid in that they directly transfer all user hip movement to the carrying portion and therefore require synchronization of hip and carrying portion movements. For example, if one hip is raised, the corresponding side of the carrying portion must also be raised. Unfortunately, this synchronization of movements causes the user to perform unnecessary work as a result of repeatedly raising the weight of the carrying portion with each stride. In addition, a user generally leans forward in the sagittal plane while walking uphill, and the dorsal hip region intermittently tilts slightly forward in the sagittal plane during movement. The necessary synchronization of hip and carrying portion movements thereby causes the carrying portion to be raised and lowered as a result of the sagittal movement. Over long distances and higher pack weights, the required synchronization of hip and carrying portion movements significantly increases the workload of the user.

Some of these problems have been overcome by existing hip attachments systems, but each respective system has failed to efficiently provide optimal articulation without introducing additional problems. For example, merely allowing the hip attachment point to freely rotate coronally will result in undesirable weight distribution at particular lateral lean angles. In addition, many of the existing articulating hip attachment systems require elimination of existing adjustability functions such as a torso length adjustment.

Therefore, there is a need in the industry for an improved carrying system hip-type user attachment system that provides the optimal articulation characteristics while maintaining existing adjustment and comfort parameters.

SUMMARY OF THE INVENTION

The present invention relates to backpacks and other carrying systems which encircle a user's waist for support. One embodiment of the present invention relates to a user-based carrying system capable of independent transportation of a load including a hip-based user attachment system. The carrying system includes an enclosure member having an internal region encased by an internal surface. A user attachment system releasably secures the carrying system to the user for independent transportation without requiring muscular engagement. The user attachment system includes a hip attachment system with a dorsal articulation member and a strap member. The dorsal articulation member includes a front and rear member three-dimensionally moveably coupled to one another. The rear member is coupled to the enclosure member, and the front member is coupled to the strap member. The three-dimensional moveable coupling between the front and rear members includes three restricted degrees of freedom configured to efficiently absorb corresponding user hip movements and directly support other user hip movements. The three restricted freedoms are a restricted rotational coronal freedom, a restricted transverse tilt freedom, and a restricted sagittal tilt freedom. Each of the restricted three dimensional freedoms enables a user to articulate their waist or hips in a particular orientation and/or amount without raising the enclosure member. A second embodiment of the present invention relates to a method for moveably coupling a strap member to an enclosure member in order to efficiently articulate a waist attachment system, thus forming an efficient user-based independent carrying system.

Embodiments of the present invention represent a significant advance in the field of hip-type user attachment systems for carrying systems. The inclusion of restricted three-dimensional movement freedoms between the hip attachment system and the carrying member ensures that only specific desirable hip articulation movements are translated to the carrying member while others are absorbed. Conventional systems have failed to account for all three specific orientations of hip articulation which should not be translated to an efficient carrying member. Likewise, conventional systems have failed to properly restrict the amount of freedom for each orientation of the moveable coupling. Therefore, conventional carrying systems that include hip-based attachments have failed to provide an overall degree of load carrying efficiency by failing to properly absorb particular user hip movements. Over long distances or periods of time, a failure to absorb certain hip movements causes a significant increase in workload upon a user. In addition, embodiments of the present invention may be utilized in conjunction with conventional torso adjustment systems and shoulder strap systems without compromising on the hip attachment performance characteristics.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
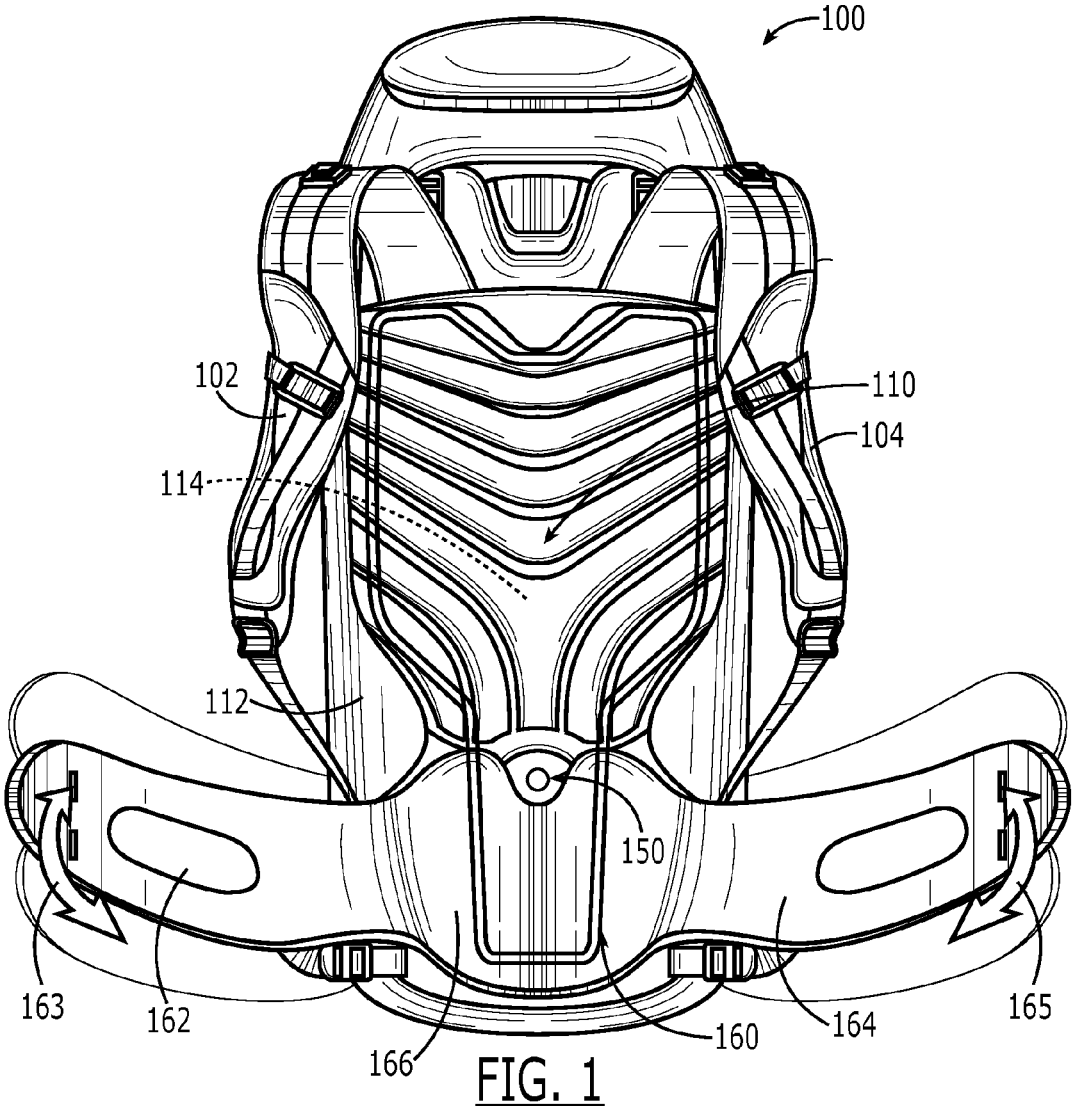
FIG. 1 illustrates a front view of a carrying system incorporating a hip attachment system in accordance with embodiments of the present invention.

The present invention relates to backpacks and other carrying systems which encircle a user's waist for support. One embodiment of the present invention relates to a user based carrying system capable of independent transportation of a load including a hip-based user attachment system. The carrying system includes an enclosure member having an internal region encased by an internal surface. A user attachment system releasably secures the carrying system to the user for independent transportation without requiring muscular engagement. The user attachment system includes a hip attachment system with a dorsal articulation member and a strap member. The dorsal articulation member includes a front and rear member three-dimensionally moveably coupled to one another. The rear member is coupled to the enclosure member and the front member is coupled to the strap member. The three-dimensional moveable coupling between the front and rear members includes three restricted degrees of freedom configured to efficiently absorb corresponding user hip movements and directly support other user hip movements. The three restricted freedoms are a restricted rotational coronal freedom, a restricted transverse tilt freedom, and a restricted sagittal tilt freedom. Each of the restricted three dimensional freedoms enables a user to articulate their waist or hips in a particular orientation and/or amount without raising the enclosure member. A second embodiment of the present invention relates to a method for moveably coupling a strap member to an enclosure member in order to efficiently articulate a waist attachment system, thus forming an efficient user-based independent carrying system. Also, while embodiments are described in reference to a hip-based user attachment system, it will be appreciated that the teachings of the present invention are applicable to other types of carrying system user attachment systems such as chest-based and/or appendage-based attachment systems.

The following terms are defined as follows:

User-based carrying system—a carrying system configured to be secured to a user. A user-based carrying system may be further defined as being capable of independent transportation, meaning that it does not request a user to maintain an appendage based active muscular engagement. For example, a backpack or shoulder bag are user-based carrying systems that allow for independent transportation because they include one or two straps that may be looped over a user's torso during transportation. In contrast, a conventional briefcase is a user-based transportation system that is dependent on the user maintaining a continuous grasp of the handle or some form of appendage-torso compression during transportation.

Restricted freedom—a restricted amount of movement/articulation freedom within a particular orientation or plane. For example, a restricted vertical freedom may be a particular finite movement or articulation type within a vertical orientation. The particular movement may be a distance, an angle, etc. A yoyo toy has a particular restricted freedom to only extend the length of the string to which it is attached.

Three-dimensional moveable coupling—a coupling between two members that permits the members to move with respect to one another in at least three orthogonal planes of movement. For example, an anatomical hip joint includes a ball and socket type moveable coupling that allows a user to move three dimensionally.

Sandwich coupling—a coupling between at least three members in which the outer or peripherally disposed member(s) are coupled to one another so as to be also effectively couple the medial or internally disposed members. A sandwich coupling may utilize various schemes that allow for movement between members. For example, a sandwich coupling may include routing a coupler through a central recess of a first and second member. The coupler may include a specific geometrical shape on either side that is larger than the central recesses of the first and second member, thereby sandwich coupling the members via chocking.

Coronal plane—a vertical anatomical plane equally splitting the front and rear portion.

Transverse plane—a horizontal anatomical plane equally splitting the top and bottom portion.

Sagittal plane—a vertical anatomical plane equally splitting the left and right side portions.

Waist region—an anatomical region corresponding to the abdominal area around a user's navel. The waist region may also be referred to as the hips and/or the hip region.

Figure 2:
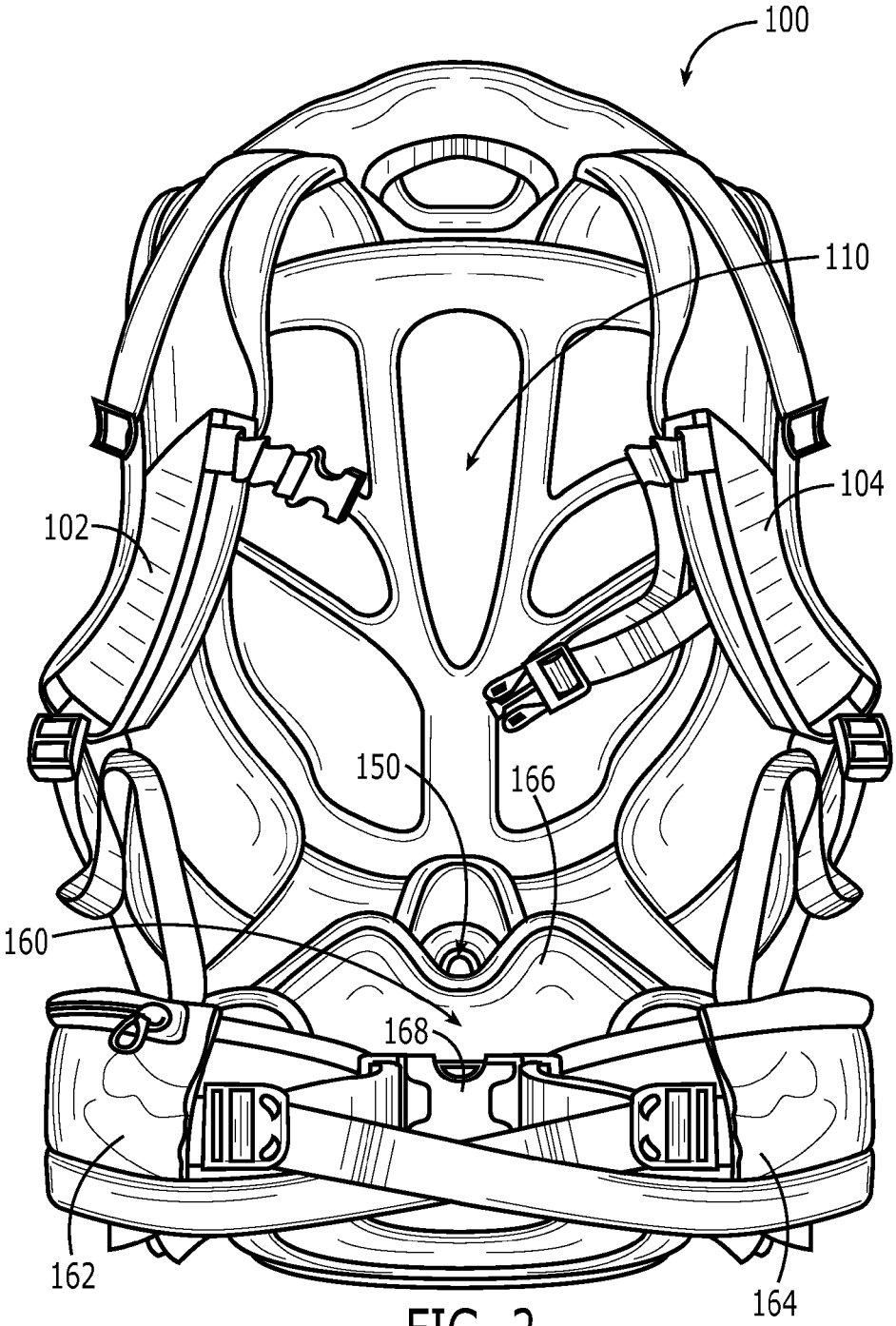
FIG. 2 illustrates an alternative front view of the carry system of FIG. 1.
Figure 3:
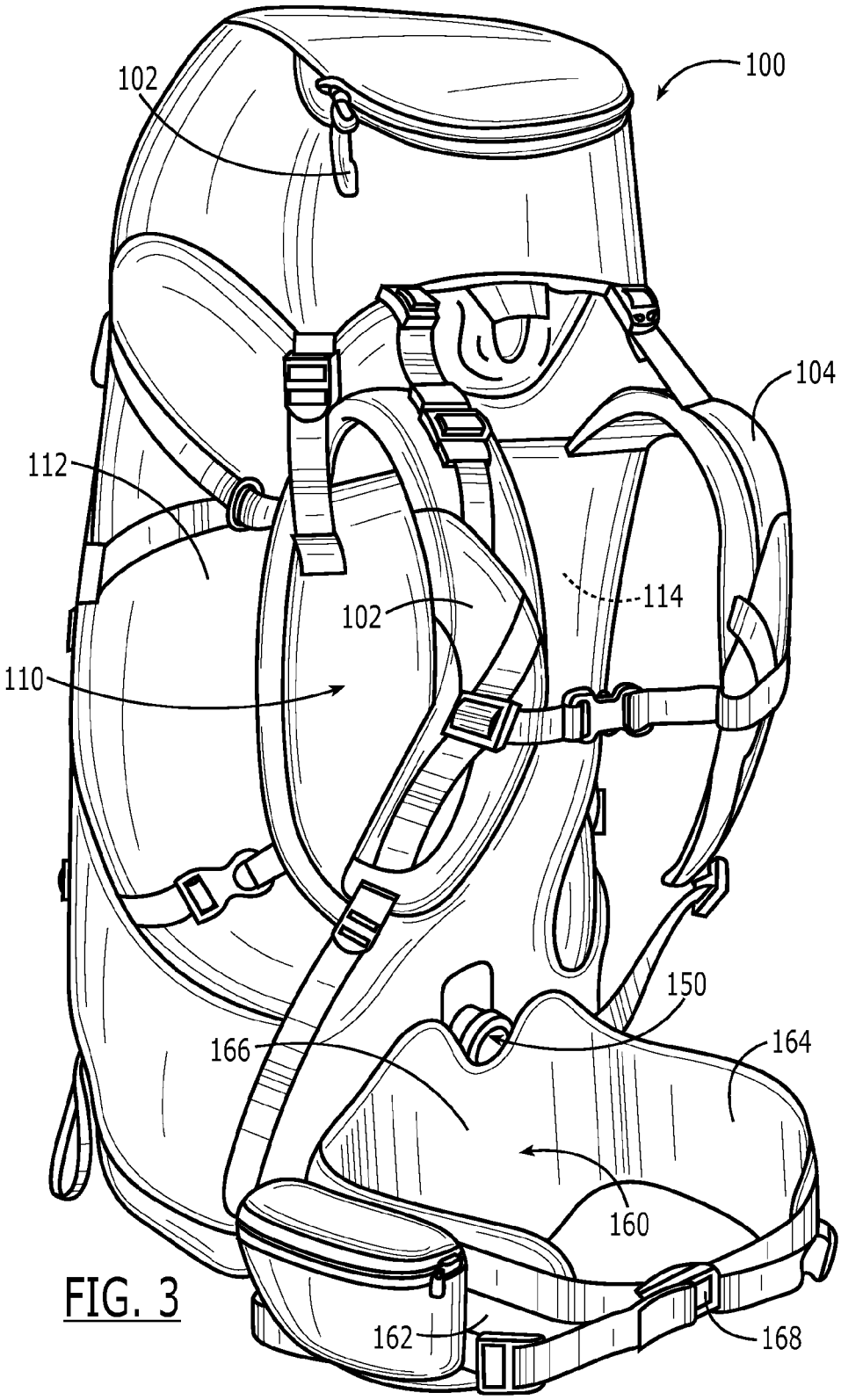
FIG. 3 illustrates a perspective view of the carrying system of FIG. 1.

Reference is initially made to FIGS. 1-3, which illustrate views of a user-based carrying system, designated generally at 100. The illustrated carrying system 100 is configured to facilitate independent transportation of a load by a user. The system 100 includes an enclosure member 110 and a user-attachment system. The enclosure member 110 defines an internal region 112 substantially encased by an internal surface. The internal region 114 is a three dimensional region capable of storing items. The enclosure member 110 further includes an external surface 112 and a lid. The external surface 112 is opposite the internal surface. The lid is selectively disposed over an upper opening to the enclosure member. Various other well known components and configurations of an enclosure member 110 may be included in accordance with embodiments of the present invention, including but not limited to compression straps, padding, secondary openings to the internal region, external storage compartments, sleeves, pockets, etc. The illustrated user attachment system includes a hip attachment system and a first and second shoulder strap 102, 104. The shoulder straps 102, 104 are configured to extend vertically or sagittally around the shoulder regions of a user, thereby encircling the shoulder straps 102, 104 and the enclosure member 110 around the user's shoulder regions. The shoulder straps 102, 104 are rigidly individually coupled at the top end of the external surface of the enclosure member 110. The shoulder straps 102, 104 are optional components conventionally found on backpack type carrying systems but are not required for implementation of embodiments of the present invention. The illustrated hip attachment system includes a dorsal articulation member 150 and a strap member 160.

The strap member 160 is configured to transversely extend around a user's waist region and selectively releasably couple at a ventral waist region so as to continuously encircle the waist region of the user. The strap member 160 further includes a dorsal pad 166, a left strap 162, a right strap 164, and a ventral coupler 168. The dorsal pad 166 is a medial strap region configured to be disposed at a dorsal portion of the user's waist region. The dorsal pad 166 is coupled to the dorsal coupler 150. The left and right straps 162, 164 are configured to extend transversely on opposite sides of the dorsal pad 166 toward the ventral region of the user in an engaged state. The left and right straps 162, 164 may include both padded and non-padded regions as illustrated in FIGS. 1-3. The coupling between the strap member 160 and the dorsal coupler 150 enables the left and right straps 162, 164 to articulate in a plurality of restricted three dimensional directions represented by the left and right movement arrow 163, 165. The particular orientations of articulation will be described in more detail below. The ventral coupler 168 is coupled on the opposite ends of the left and right straps 162, 164 with respect to the dorsal pad 166. The ventral coupler 168 is a releasable coupling mechanism that may include a left and right coupler member corresponding to the left and right straps 162, 164. The ventral coupler 166 may incorporate any form of releasable coupling mechanism such as a plastic male-female type buckle. Various well known belt systems and technologies may be utilized including but not limited to padded straps, compliant buckles, releasably adjustable strap length mechanisms, dorsal posterior padding, etc. In an engaged state, the strap member 160 encircles a user's waist/hip region; therefore, all forces corresponding to a user's hip movements are transferred to the strap member 160. However, as described below, and in accordance with embodiments of the present invention, only certain hip movement forces are transferred to the enclosure member 110 via the dorsal coupler 150.

Figure 4:
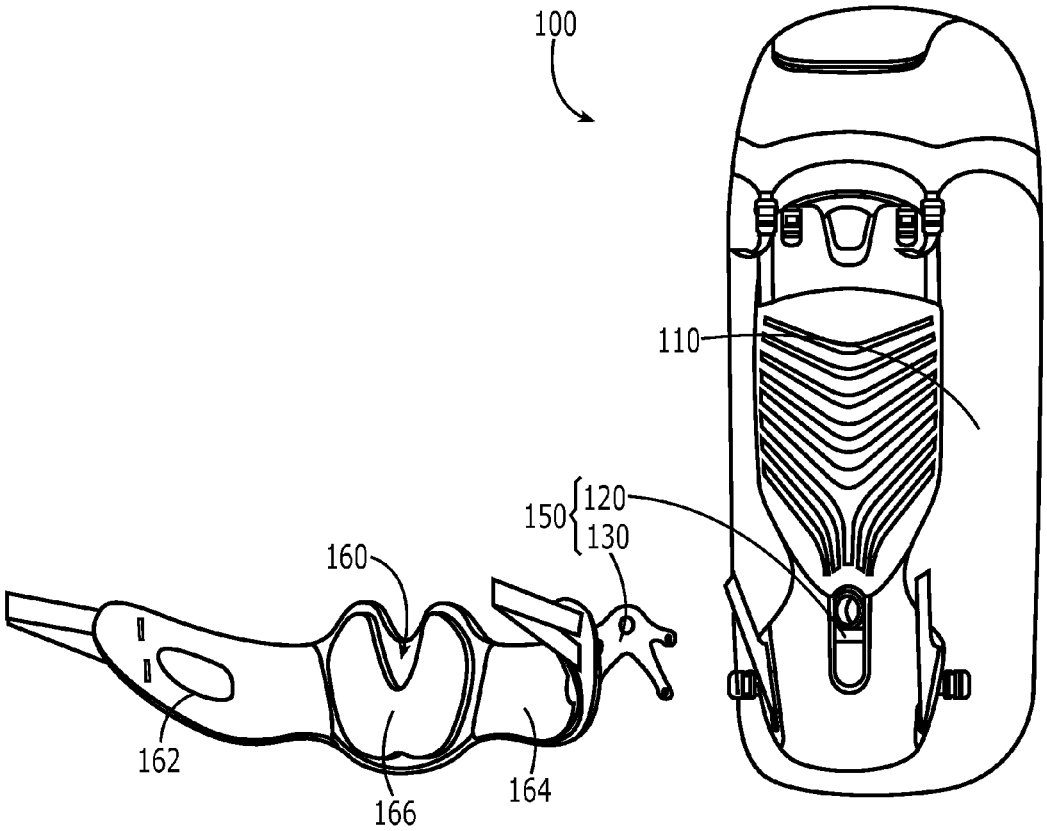
FIG. 4 illustrates an exploded view of the carrying system of FIG. 1.
Figure 5A:
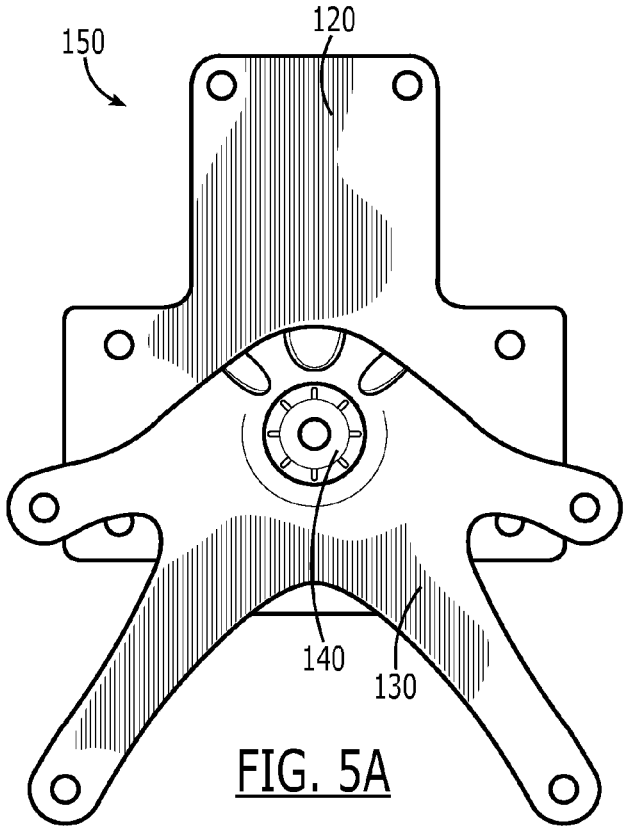
FIGS. 5A and 5B illustrates a front and profile view of the dorsal articulation member of FIG. 1.
Figure 5B:
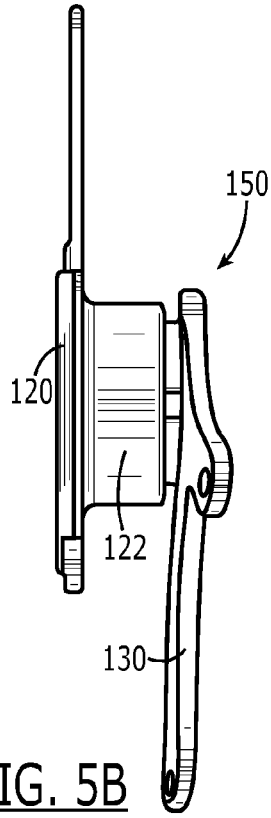
Figure 6A:
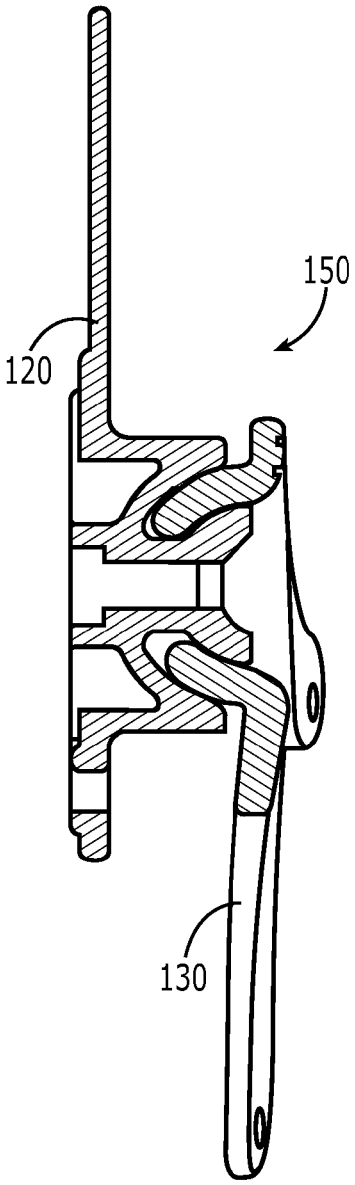
FIGS. 6A and 6B illustrate cross sectional views of the front portion of the dorsal articulation member of FIG. 1.
Figure 6B:
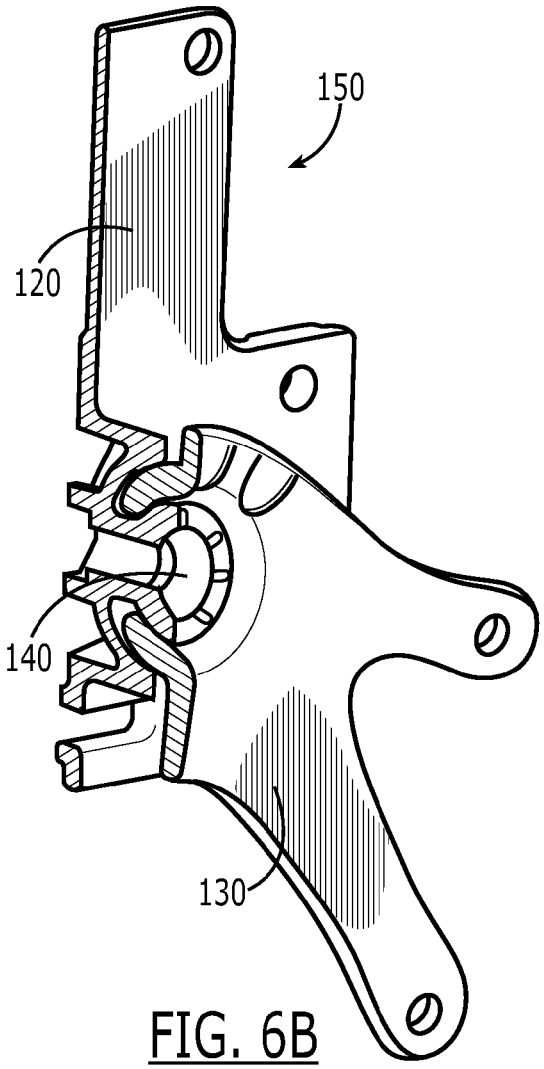

Reference is next made to FIG. 4, which illustrates the exploded coupling scheme of the strap member 160 and the enclosure member 110 via the dorsal coupler 150. The dorsal coupler 150 includes a front member 130 coupled to the strap member 160 and a rear member 120 coupled to the enclosure member 110. The front and rear members 130, 120 are three-dimensionally moveably coupled to one another so as to permit three dimensional movement therebetween. The three-dimensionally moveable coupling includes three restricted orientations of movement freedom, including a restricted rotational coronal freedom, a restricted transverse tilt freedom, and a restricted sagittal tilt freedom. The three freedoms are described in terms of the corresponding anatomical planes within which the movements occur when the carrying system is engaged with a user. The engagement of the carrying system 100 with a user includes disposing the enclosure member on the dorsal side of the user's torso and encircling the strap member around the user's waist. The restricted freedoms will be discussed in more detail below in conjunction with the specific structures through which they are accomplished. In operation, the restricted freedoms effectively enable the strap member 160 to freely move with respect to the enclosure member 110 within certain orientation and quantity parameters. Therefore, certain incidental hip movements are not translated to the enclosure member 110. However, hip movements that exceed or fall outside of the restricted freedoms are translated to the enclosure member 110 to allow for proper support. While walking, for example, a user naturally raises each hip individually to a certain extent in correspondence with the forward leg. This unbalanced hip-based movement corresponds to a coronal rotation of the strap member 160 with respect to the enclosure member 110. Likewise, certain user hip movements correspond to a transverse tilt and a sagittal tilt between the strap member 160 and the enclosure member 110.

The front member 130 includes a web-shaped, plate-like structure rigidly coupled to the dorsal pad 166 of the strap member 160, as illustrated. The rigid coupling refers to a coupling scheme through which movements of the strap member 160 are directly translated to the front member 130. The web shaped plate configuration of the front member 130 enables an optimal coupling with the strap member 160. However, it will be appreciated that other planar shaped structures may be utilized for the front member 130 and remain consistent with the present invention. The rear member 120 also includes a plate-like shape structure. The rear member 120 is coupled to the enclosure member 110. The coupling between the rear member 120 and enclosure member 110 is configured to dispose a portion of the rear member 120 within the internal region 114 (see FIG. 1-3) of the enclosure member 110 while allowing external access to a coupling region. In the illustrated embodiment, a flat, plate-like portion of the rear member 120 is disposed within the internal region 114 while a circular coupler region is exposed. The coupling between the rear member 120 and the enclosure member 110 may also include a torso-length translational adjustment system. Therefore, the rear member 120 may be configured to selectively translate coronally with respect to the enclosure member 110 to accommodate differences in user torso length and/or relative waist region locations. However, any optional torso-length translational adjustment system is configured to selectively rigidly support the rear member 120 with respect to the enclosure member 110 in the selected lengthwise position. Therefore, an elevation or tilt of the rear member 120 correspondingly elevator tilts the enclosure member 110.

The front member 130 is coupled to the rear member 120 via a three dimensional restricted moveable coupling. The restricted three dimensional moveable coupling includes a restricted rotational coronal freedom, a restricted transverse tilt freedom, and a unidirectional restricted sagittal tilt freedom. The three restricted freedoms selectively allow particular movement orientations of the user's hips to be translated to the enclosure system to product optimal carrying efficiency according to anatomical movement parameters. During movement, it is known that humans anatomically raise and tilt their hips and waist region sequentially corresponding to the forward most foot so as to effectively distribute weight. It is undesirable for a carrying system user to incur the additional work requirement to raise the load contained within the enclosure member during movement. Therefore, the three restricted freedoms of movement between the front and rear members 130, 120 prevent selected movements from translating to the enclosure member 110. A user may thereby raise/tilt their waist region within particular parameters while avoiding translation of movement to the enclosure member 110. The restricted rotational coronal freedom allows a user to laterally articulate their hips up or down within 10 degrees to the enclosure member 110. Likewise, the restricted transverse tilt freedom allows a user to transversely tilt their hips forward or rearward within 10 degrees while avoiding translation of movement to the enclosure member 110. In addition, the unidirectional restricted sagittal tilt freedom allows a user to only tilt their hips forward 10 degrees while avoiding translation of movement to the enclosure member 110. The forward tilt of a user's hips may also be described as a clockwise rotation of the pelvis from a profile perspective. It will be appreciated that the 10 degree range described in reference to the illustrated embodiment is not to be construed as limiting on the implementation of embodiments of the present invention. Therefore, embodiments of the present invention may be practiced with restricted ranges above or below that which described in reference to the illustrated embodiment.

Figure 7:
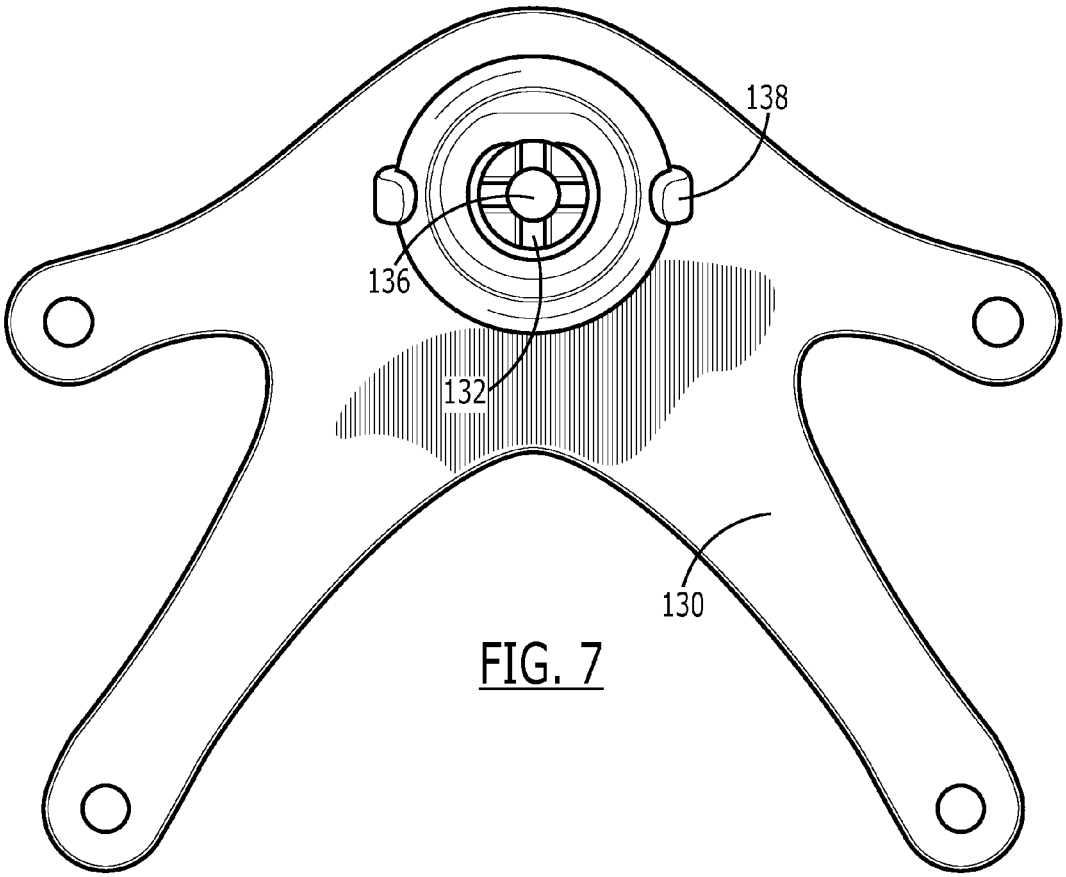
FIG. 7 illustrates a front view of the front portion of the dorsal articulation member of FIG. 1.
Figure 8:
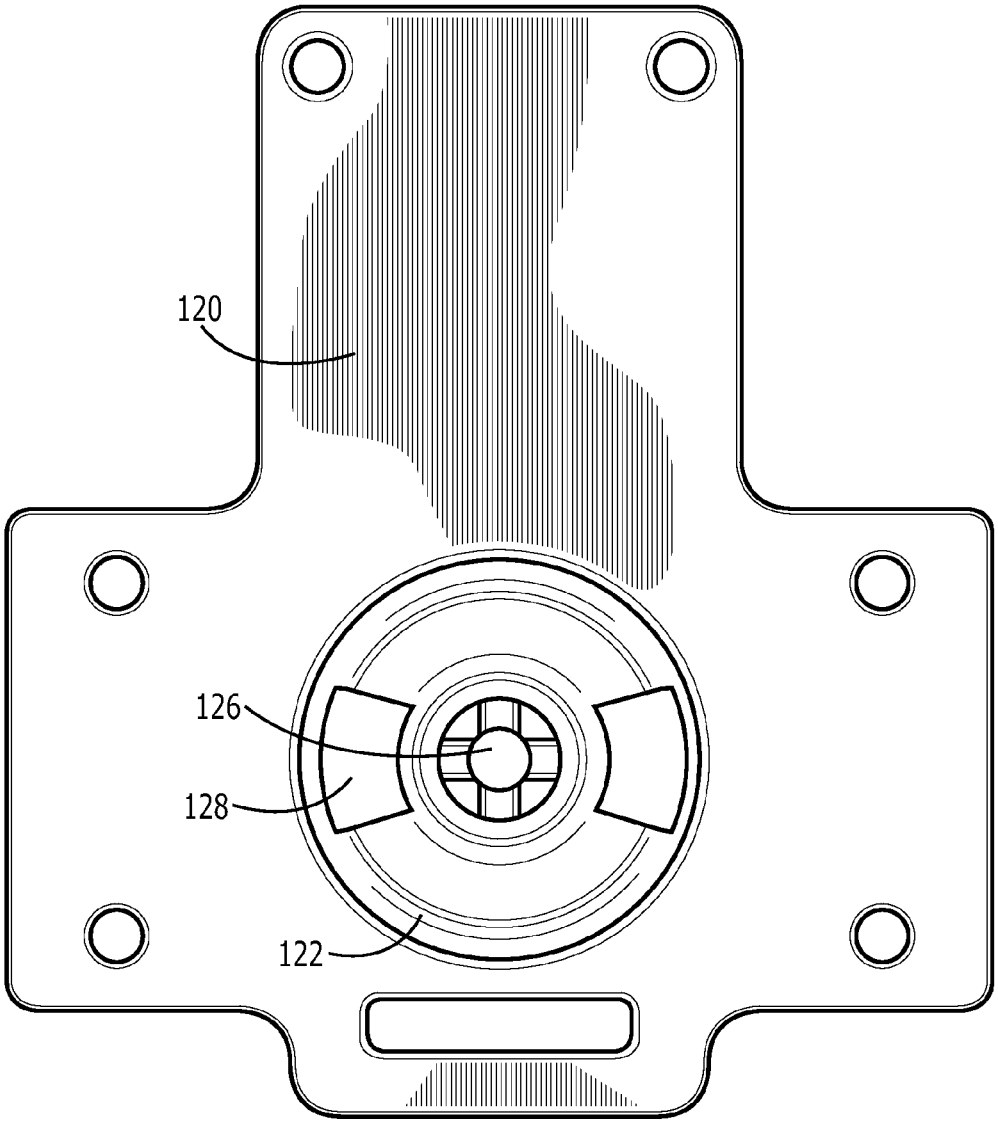
FIG. 8 illustrates a front view of the rear portion of the dorsal articulation member of FIG. 1.

Reference is next made to FIGS. 5-8 which illustrates various views of the components and architecture of the dorsal articulation member 150 of FIG. 1. FIGS. 5A, 5B, 6A and 6B illustrate views of an assembled dorsal articulation member 150, including the front member 130, rear member 120, and a coupler 140. FIGS. 7 and 8 illustrate the front and rear members 130, 120 individually. The front member 130 and rear member 120 both include planar regions and coupling regions, respectively. The front member 130 includes a web shaped plane region, a circular convex coupling region 132, and a recess 136 (see FIG. 7). Likewise, the rear member 120 includes an inverted T-shaped plane region, a raised circular concave coupling region 122, and a recess 126 (see FIG. 8). The circular convex coupling region 132 of the front member 130 is positioned within the raised concave coupling region 122 of the rear member 120 and the coupler 140 is extended through the respective recesses 126, 136 to effectuate sandwich coupling the front and rear members 130, 120 together. The coupler 140 is only loosely coupled over the front and rear member 130, 120 to preserve the three dimensional freedom of movement therebetween. This coupling between the front and rear members 130, 120 is analogous to a ball (convex coupling region 132 of front member 130) and socket (concave coupling region 122 of the rear member 120) coupling scheme. It will be appreciated that the concave and convex surfaces may be interchangeable between the front and rear members 130, 120 without affecting the functionality.

The surfaces of the front and rear members 130, 120 include specific structures to effectuate the three restricted freedoms of movement. The first restricted rotational coronal freedom corresponds to a substantially parallel rotational freedom between the plane-shaped structures of the front and rear members 130, 120. This rotational freedom is generally inherent to concave-convex type couplings in which the concave and convex curvatures substantially match or correspond to one another. However, to restrict the freedom to allow only 10 degrees of rotation in either parallel rotational direction, a set of tabs 138 and channels 128 are included on the coupling regions 132, 122 of the front and rear members 130, 120, respectively. The tabs 138 are positioned on the lateral sides of the convex coupling region 132 of the front member 130, which is oriented toward the rear member 120. The rear member 120 includes channels 128 within the raised concave coupling region 122 within which the tabs 138 are positioned. The sandwich coupling parameters between the front and rear members 130, 120 and the corresponding thickness of the tabs 138 and channels 128 selected contain the tabs 138 within the channels 128. The radial shape of the channels 128 thereby limits the rotational freedom of the tabs 138 to rotate with respect to the rear member 120. It will be appreciated that the radial dimensions of the channels 128 and tabs 138 may be adjusted to increase or decrease the rotational freedom.

The second restricted transverse tilt freedom corresponds to a freedom to laterally tilt (raise one side and lower the other side) the front member 130 with respect to the rear member 120. This form of freedom is also generally inherent to concave-convex type couplings in which the concave and convex curvatures match or correspond to one another. However, to restrict the freedom to only 10 degrees in either lateral direction, the diameter of the front portion recess 126 and the coupler 140 are specifically sized and shaped to obstruct tilt freedom beyond the desired parameters. The tab 138 and channel 128 structure thickness may also be specifically shaped to coordinate with the coupler 140 sandwich coupling parameters so as to restrict the lateral freedom to the selected parameters. It will be appreciated that the thicknesses and curvatures may be altered to increase or decrease the transverse tilt freedom.

The third restricted sagittal tilt freedom corresponds to vertically tilting the front member 130 with respect to the rear member 120. This form of freedom is also generally inherent to concave-convex type couplings in which the concave and convex curvatures match or correspond to one another. The third restricted sagittal tilt freedom is unidirectional. However, to restrict the freedom to only one direction and only specific angles within that direction, the shaped and diameter of the front member recess 126 coordinated with the coupler 140 are specifically sized and shaped to obstruct tilt freedom beyond the desired parameters. To effectuate the unidirectionally restricted freedom, the front member recess 126 is slightly off-set downward, thereby positioning the top portion of the front member recess 126 directly against the coupler 140 and allowing the desired articulation downward only. This slight offset is best illustrated and designed in the profile view of FIG. 6A and front view of FIG. 7. The tab 138 and channel 128 structure thickness may also be specifically shaped to coordinate with the coupler 140 sandwich coupling parameters to restrict the lateral freedom to the selected parameters. It will be appreciated that the thicknesses, curvatures, and offsets may be altered to increase or decrease the transverse tilt freedom.

Various other embodiments have been contemplated, including combinations in whole or in part of the embodiments described above. Various additional components and or materials may be used in conjunction with embodiments of the present invention.

What is claimed is:

1. A user-based carrying system capable of independent transportation of a load, comprising:

an enclosure member having an internal region substantially encased by an internal surface, wherein the enclosure member includes an external surface opposite the internal surface;

a user attachment system configured to releasably secure the enclosure member to a user, wherein the user attachment system includes a hip attachment system comprising:

a dorsal articulation member comprising a front and rear member three-dimensionally moveably coupled to one another, wherein the rear member is coupled to the enclosure member, and wherein the three-dimensional moveable coupling between the front and rear members includes a restricted rotational coronal freedom, a restricted transverse tilt freedom, and a restricted sagittal tilt freedom, wherein the restricted sagittal tilt freedom between the front and rear portion is unidirectional from a substantially parallel configuration of the front and rear member; and a strap member rigidly coupled to the front member of the dorsal articulation member, wherein the strap member laterally extends around the waist region of the user and releasably couples at a ventral waist region thereby continuously encircling the waist region of the user.

2. The carrying system of claim 1, wherein the three-dimensional moveable coupling includes a cylindrical coupling point between the front and rear member.

3. The carrying system of claim 1, wherein the restricted rotational coronal freedom between the front and rear portion includes a freedom to only rotate the front member with respect to the rear member within 10 degrees in either lateral rotational direction in an orientation corresponding to the coronal anatomical plane of the user.

4. The carrying system of claim 1, wherein the restricted transverse tilt freedom between the front and rear portion includes a freedom to only laterally tilt the front member with respect to the rear member within 10 degrees in either lateral tilt direction in an orientation corresponding to a transverse anatomical plane of the user.

5. The carrying system of claim 1, wherein the restricted sagittal tilt freedom between the front and rear member includes a unidirectional freedom to only laterally tilt the front portion with respect to the rear member within 10 degrees in the downward sagittal direction in an orientation corresponding to a sagittal anatomical plane of the user.

6. The carrying system of claim 1, wherein the restricted sagittal tilt freedom between the front and rear member is unidirectional.

7. The carrying system of claim 1, wherein the enclosure member is disposed on the dorsal region of the user and in substantial alignment with a spine region of the user.

8. The carrying system of claim 1, wherein the rear member is disposed substantially within the internal region of the enclosure member and wherein the front member is disposed substantially external to the internal region.

9. The carrying system of claim 1, wherein the strap member further includes a dorsal pad, a left strap, a right strap, and a ventral coupler.

10. The carrying system of claim 9, wherein the dorsal pad is directly coupled to the front member, and wherein the left and right strap extend transversely from the dorsal pad.

11. The carrying system of claim 10, wherein the ventral coupler includes a left and right coupler member disposed on the furthest most portions of the left and right straps with respect to the dorsal pad, and wherein the left and right coupler members are configured to releasably couple.

12. The carrying system of claim 1, wherein the dorsal articulation member further includes a dorsal coupler configured to sandwich couple at least a portion of the front member between the dorsal coupler and the rear member.

13. The carrying system of claim 1, wherein the three dimensional moveable coupling of the front and rear members include corresponding concave and convex regions.

14. The carrying system of claim 13, wherein the concave and convex regions include a recess through which a dorsal coupler sandwich coupled the front member to the rear member.

15. The carrying system of claim 13, wherein the concave and convex regions include specific geometries corresponding to the restricted rotational coronal freedom, restricted transverse tilt freedom, and restricted sagittal tilt freedom.

16. A user-based carrying system capable of independent transportation of a load, comprising:

an enclosure member having an internal region substantially encased by an internal surface, wherein the enclosure member includes an external surface opposite the internal surface;

a user attachment system configured to releasably secure the enclosure member to a user, wherein the user attachment system includes a hip attachment system comprising:

a dorsal articulation member comprising a front and rear member three-dimensionally moveably coupled to one another, wherein the rear member is coupled to the enclosure member, and wherein the three-dimensional moveable coupling between the front and rear members includes a restricted rotational coronal freedom, a restricted transverse tilt freedom, and a restricted sagittal tilt freedom, wherein the three dimensional moveable coupling of the front and rear members include corresponding concave and convex regions that further include specific geometries corresponding to the restricted rotational coronal freedom, restricted transverse tilt freedom, and restricted sagittal tilt freedom; and a strap member rigidly coupled to the front member of the dorsal articulation member, wherein the strap member laterally extends around the waist region of the user and releasably couples at a ventral waist region thereby continuously encircling the waist region of the user.

17. The carrying system of claim 16, wherein the dorsal articulation member further includes a dorsal coupler configured to sandwich couple at least a portion of the front member between the dorsal coupler and the rear member.

* * * * *